US006000382A

United States Patent [19]

Albisetti

[11] Patent Number: 6,000,382

[45] Date of Patent: Dec. 14, 1999

[54] MAGNETIC POLARIZATION DEVICE FOR TREATING FUEL

[75] Inventor: Maurizio Albisetti, Morbio Inferiore, Switzerland

[73] Assignee: Samuel Abraham, Milan, Italy

[21] Appl. No.: 09/101,161

[22] PCT Filed: Jan. 4, 1996

[86] PCT No.: PCT/IB96/00005

§ 371 Date: Jul. 2, 1998

§ 102(e) Date: Jul. 2, 1998

[87] PCT Pub. No.: WO97/25528

PCT Pub. Date: Jul. 17, 1997

[51] Int. Cl.[6] ..... F02M 27/04

[52] U.S. Cl. ..... 123/538

[58] Field of Search ..... 123/536, 537, 123/538; 210/222, 695

[56] References Cited

U.S. PATENT DOCUMENTS

| | | | |
|---|---|---|---|
| 4,357,237 | 11/1982 | Sanderson | 123/538 |
| 5,487,370 | 1/1996 | Miyazaki | 123/538 |
| 5,664,546 | 9/1997 | De Le Torre Barreiro | 123/538 |
| 5,716,520 | 2/1998 | Mason | 123/538 |
| 5,816,226 | 10/1998 | Jernigan et al. | 123/538 |

*Primary Examiner*—Marguerite McMahon
*Attorney, Agent, or Firm*—Young & Thompson

[57] ABSTRACT

In a magnetic polarization device for a fuel supply circuit, comprising multi-pole bar magnets contained in a casing which has internal passage vanes for the fuel, each bar magnet is made up of a different number of contiguous bipolar magnetic segments with magnetic fields of increasing intensity from one end to the other, which are aligned axially with one another with like-directed magnetic polarities adjacent each other, and which have unlike-directed magnetic polarities corresponding to the ends of each bar, and one or more fluid-carrying bars made of a ferromagnetic material are arranged parallel to each multi-pole bar magnet.

4 Claims, 3 Drawing Sheets

MAGNETIC POLARIZATION DEVICE FOR TREATING FUEL

FIELD OF THE INVENTION

The object of this invention is a magnetic-polarization device that can be used to improve the degree of atomization of a fuel that is to be injected and then combusted, as is done in, e.g., internal-combustion engines with fuels of any type (gasoline, diesel fuel, alcohols), in burners, and in heaters.

BACKGROUND OF THE INVENTION

It is known that, by improving the atomization of the jet of fuel and reducing the mean diameter of the injected droplets, the process of evaporation and/or heating to the temperature where combustion starts is accelerated, thus primarily ensuring a lower combustion temperature overall; this has a beneficial effect on the yield of the relative thermodynamic cycle and improves combustion overall, while reducing uncombusted and partially combusted components such as CO.

Magnetic-polarization devices are already known that subject the fuel, circulating in a feed circuit, to predetermined concatenated magnetic fluxes with permanent bar magnets, behind which the fuel is made to flow before it is injected.

An example is disclosed in U.S. Pat. No. 4,201,140:

In terms of its design and the arrangement of its parts, magnetic and non-magnetic, this kind of device calls for external shielding, which is expensive and difficult to produce, and achieves polarization results that are less good than those of the device of this invention owing to the different arrangement of the lines of flux, as will be further explained below. In particular, flux carrying members, that will be described below, are not present in any example of the prior art.

It is known that the most probable theory that accounts for the results mentioned above postulates that the polarization treatment reduces the electromagnetic forces of cohesion between molecules that have polar axes oriented in different ways.

As a result, better polarization of the molecules that make us the fuel corresponds to more energetic action of the magnetic fluxes which have a direction that varies abruptly as the fuel flows along the magnets; the molecules, whose polar axes tend to line up under the action of the external magnetic flux to which they are subjected, thus lose the order that creates the cohesion among the molecules themselves.

This is achieved with the device according to the invention which, as already mentioned, also turns out to be less expensive than those known to the current state of the art.

SUMMARY OF THE INVENTION

The object of the invention consists of a magnetic polarization device for a fuel supply circuit for burners or for internal-combustion engines comprising parallel multi-pole bar magnets (2) lodged inside a casing (6) that forms inside of itself passage vanes (9) through which said fuel can flow, wherein each of said multi-pole bar magnets (2) is made up of an odd number of contiguous bipolar magnetic segments (2*a,* 2*b,* 2*c*) that are aligned axially, facing one another with like-directed magnetic polarities, and thus having polarities of opposite directions corresponding to the ends of each bar (2), characterized in that said magnetic segments have concatenated magnetic fields of increasing intensity, as well as in that, between each pair of multi-pole bar magnets (2), equidistant from the latter, is arranged one parallel flux carrying bar (3, 3*e*) that is made of a ferromagnetic material, so as to generate a plurality of flux lines that traverse, with flux rising along each bar (3, 3*e*) zones (9) through which passes the fuel to be treated.

BRIEF DESCRIPTION OF THE DRAWINGS

A more detailed description of an embodiment of the device will be given below, also referring to the drawings, where.

DETAILED DESCRIPTION OF THE DRAWINGS

Figure 1:
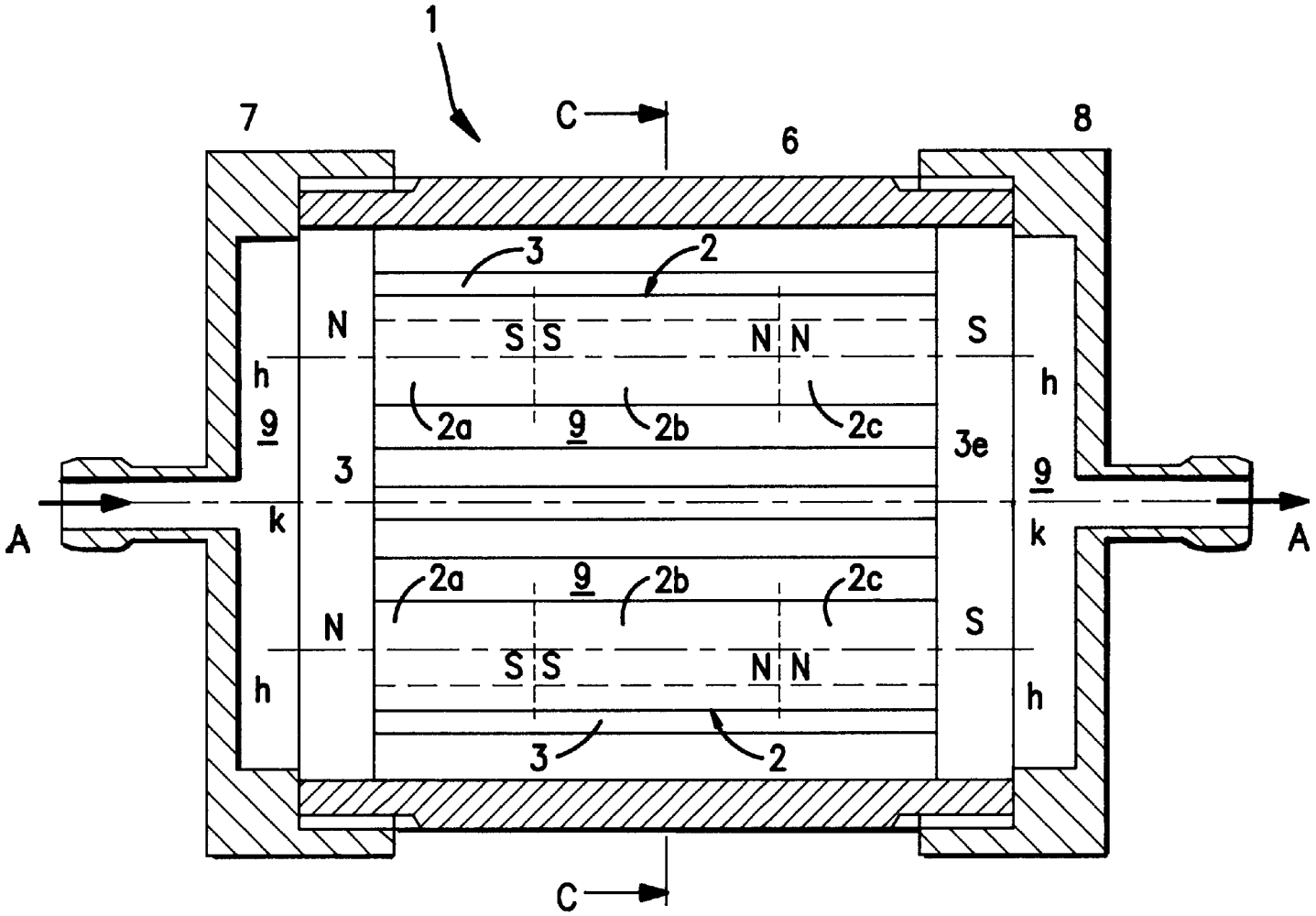
FIG. 1 shows a side view, partial section, of this embodiment of the device.

FIG. 1 shows how the device is made up of one or more multi-pole bar magnets 2, four in the figure, which are composed of permanent magnets of a known type with a magnetic induction of between 2000 and 12,000 gauss.

Figure 2:
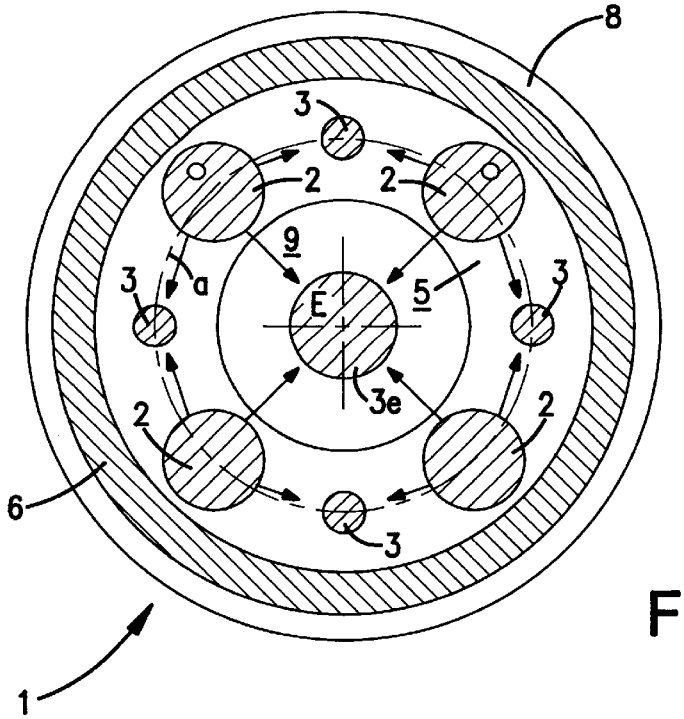
FIG. 2 shows a cross-section of the device of FIG. 1.
Figure 3:
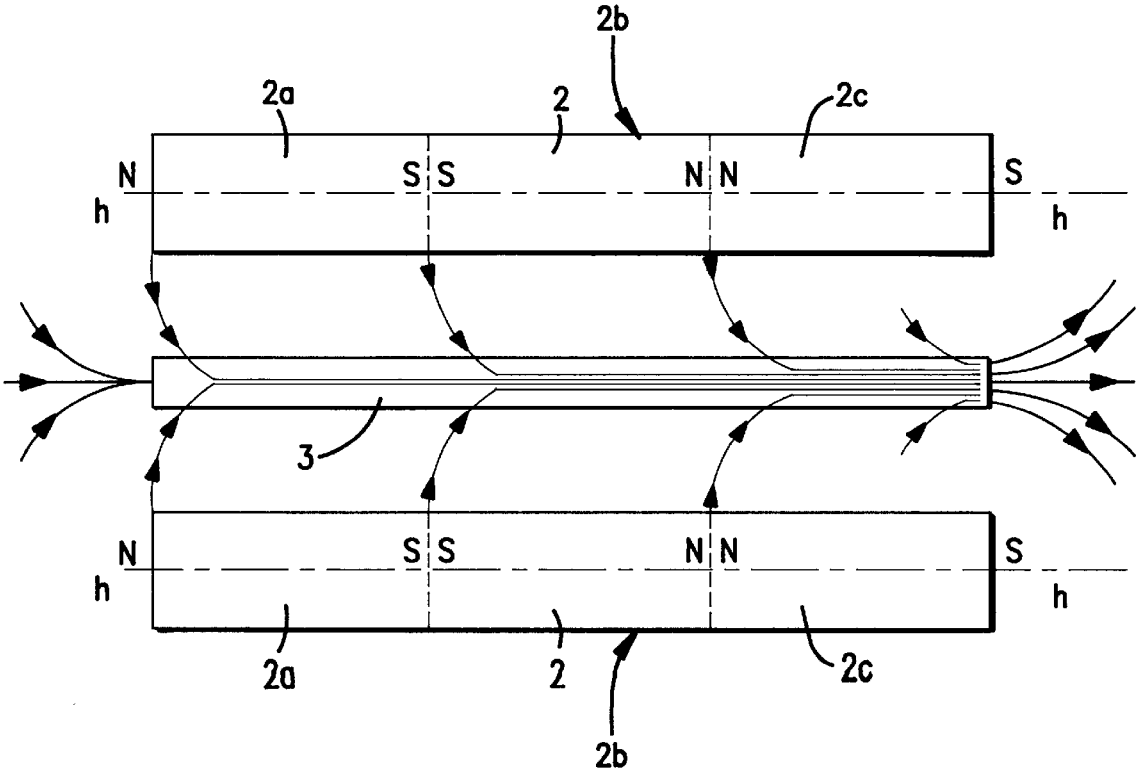
FIG. 3 shows a side view of two multi-pole bars between which is placed a flux-carrying bar; here the paths of the lines of magnetic flux, indicated by arrows, are visible.

As FIGS. 2 and 3 show more clearly, said bars 2, which are arranged parallel and equidistant, are composed of two contiguous bipolar magnetic segments 2*a,* 2*b,* 2*c,* which are lined up and face one another with alternating like-directed polarities N—N or S—S, as indicated in the figure; the permanent magnetic fields that are concatenated to said segments increase in intensity moving from one end of multi-pole bar magnet 2 to the other (toward the right in FIGS. 1 and 3).

Bars 2, which have a circular section in the example shown, can also have sections in the shape of polygons or other forms. It is beneficial for centers 0 of the straight segments of bar magnets 2 to rest on circumferences that are perpendicular to longitudinal axes h—h of bar magnets 2 themselves.

In device 1 according to the invention, parallel to each of said multi-pole bar magnets 2 are arranged one or more flux-carrying bars 3, 3*e* that are made of a ferromagnetic material and have a section as desired (circular in the figures). In the figures, one bar 3 of said bars is arranged between each pair of multi-pole bar magnets 2, equidistant from the latter, and another flux-carrying bar 3*e,* which also has a circular section, is then arranged with its longitudinal axis K—K passing through said centers E of circumferences (a) on which rest centers 0 of the straight segments of multi-pole bar magnets 2.

The paths of lines of magnetic flux are roughly indicated in FIGS. 2 and 3; it is evident how said lines traverse, with rising flux, zones 9 through which passes the fuel to be treated which, as it passes through the device, is consequently subjected to a magnetic polarization action of increasing intensity. The number of bars, the shapes of their sections, the presence or less of corners more or less facing one another and the distance between the different bars thus determine, depending on the designer's requirements, the presence of areas, generally corresponding to the nodal points at which the like-directed plies of successive bipolar magnetic segments face one another, in which there are flux peaks with elevated values of the function grad B.

Corresponding to said areas, the fuel, as it moves along its path (indicated by arrows A), is abruptly subjected to the action of very high and increasing magnetic induction, causing the molecules of the fuel, which have already been spread out, to become magnetically polarized.

It should be noted that each of multi-pole bar magnets 2 ends in the faces of two bipolar segments that have opposite polarizations, thus effectively closing the magnetic circuit. This is equivalent to saying that bipolar segments 2*a,* 2*b,* 2*c* that each make up multi-pole bar magnet 2 have to be odd in number (three in the case depicted).

In this same example both flux-carrying bars 3, 3*e* and multi-pole bar magnets 2 are equal in length, and their ends are lined up with one another, such that it is possible to assemble from them all of said bars 2, 3, 3*e* using simple connectors 5 made of a non-magnetic material, e.g., copper, that are able to fit into said ends.

Figure 4:
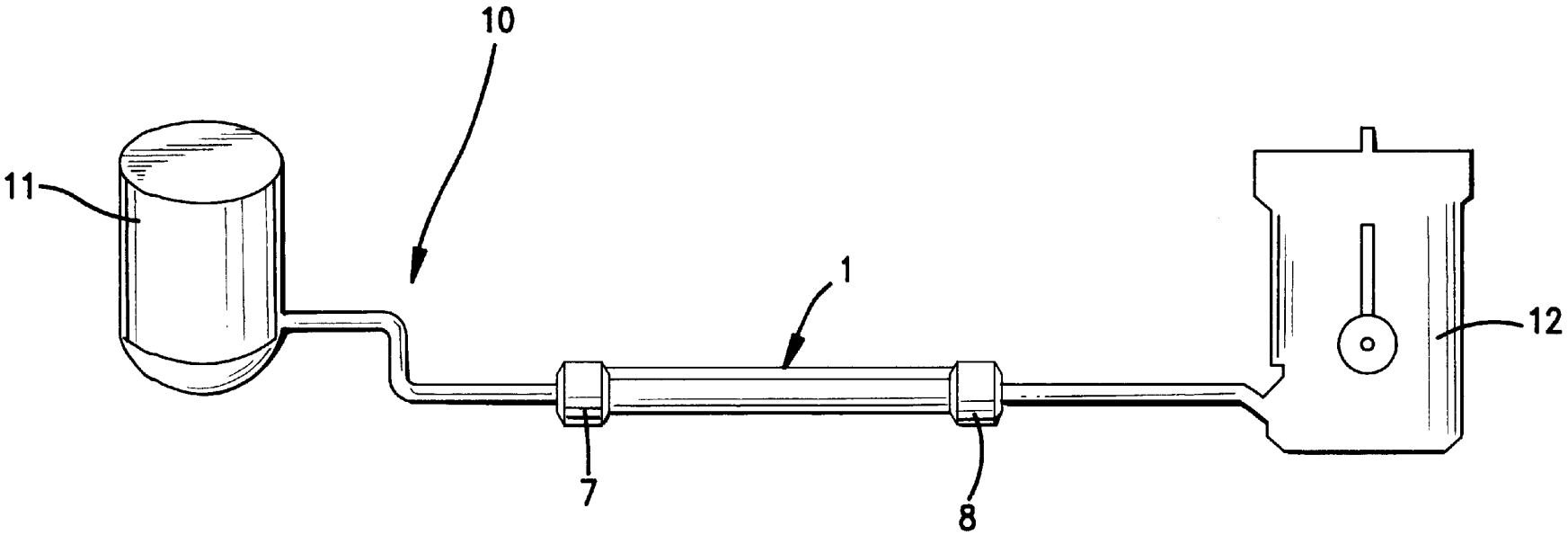
FIG. 4 shows a schematic of a device according to the invention, inserted into a fuel supply circuit.

A casing made of ferromagnetic material 6 thus contains in its interior said assembly of bars 2, 3, 3*e* and is equipped with non-magnetic connections 7, 8 to secure it to a tube of supply circuit 10 by known methods and as shown in FIG. 4, where the device is inserted between pump 11 and the intake manifold of an internal-combustion engine 12.

The results of tests on a device according to this invention turned out to be very instructive: for example, other conditions being equal, an operating internal-combustion engine experienced a reduction of up to 20% in uncombusted HC, as well as an absence of solid carbon residue in both the valve seats and on the cylinder heads. Depending on the case in question, this also means a savings in fuel of from 10 to 20%.

The lubricating oil, which should absorb very small amounts of uncombusted waste particles, has a very long service life, longer than its maximum lubricating capacity.

To the extent that they correspond to the attached claims, different embodiments fall within the scope of the protection offered by this patent application.

I claim:

1. Magnetic-polarization device (1) for a fuel-supply circuit (10) for burners or internal-combustion engines, comprising parallel multi-pole bar magnets (2) lodged inside a casing (6) having internal passage vanes (9) along which said fuel can flow, wherein 4 each of said multi-pole bar magnets (2) is made up of an odd number of contiguous bipolar magnetic segments (2*a,* 2*b,* 2*c*) that are aligned axially, facing one another with like-directed magnetic polarities adjacent each other, and thus having polarities of opposite directions corresponding to the ends of each bar (2), characterized in that said magnetic segments have concatenated magnetic fields of increasing intensity from one end to the other, as well as in that, between each pair of multi-pole bar magnets (2), equidistant from the latter, is arranged one parallel flux carrying bar (3, 3*e*) that is made of a ferromagnetic material, so as to generate a plurality of flux lines that traverse zones (9) through which the fuel to be treated passes with flux rising along each bar (3, 3*e*).

2. Device according to claim 1, in which multi-pole bar magnets (2) are parallel and equidistant to each other and are arranged with centers (0) of their straight segments resting on circumferences (a) perpendicular to their longitudinal axes (h—h), with said flux-carrying bars (3, 3*e*) being parallel to multi-pole bar magnets (2) themselves and having lengths that are essentially equal to those of the latter.

3. Device according to claim 2, in which at least one (3*e*) of flux-carrying bars (3, 3*e*) is arranged with its longitudinal axis (K—K) passing through centers (E) of the circumferences on which rest centers (0) of the straight segments of multi-pole bar magnets (2), with remaining flux-carrying bars (3) being arranged along their circumferences (a) and being equidistant and at a predetermined distance from multi-pole bar magnets (2) themselves.

4. Device according to claim 3, in which the ends of multi-pole bar magnets (2) and their flux-carrying bars (3, 3*e*) are connected by an attachment connection (5) made of a non-magnetic material.

* * * * *